US006434995B1

(12) United States Patent
Kataoka et al.

(10) Patent No.: US 6,434,995 B1
(45) Date of Patent: Aug. 20, 2002

(54) METHOD OF BENDING SMALL DIAMETER METAL PIPE AND ITS APPARATUS

(75) Inventors: Takahiro Kataoka, Numazu; Masaki Hoshino, Shizuoka, both of (JP)

(73) Assignee: Usui Kokusai Sangyo Kaisha Limited (JP)

( * ) Notice: Subject to any disclaimer, the term of this patent is extended or adjusted under 35 U.S.C. 154(b) by 0 days.

(21) Appl. No.: 09/689,450

(22) Filed: Oct. 12, 2000

(51) Int. Cl.[7] ..... B21D 7/00
(52) U.S. Cl. ..... 72/307; 72/149; 72/388
(58) Field of Search ..... 72/307, 306, 149, 72/388, 217

(56) References Cited

U.S. PATENT DOCUMENTS

| | | | | |
|---|---|---|---|---|
| 3,553,989 A | | 1/1971 | Munro et al. | |
| 4,380,917 A | | 4/1983 | Uchida et al. | 72/150 |
| 4,625,531 A | | 12/1986 | Lafrasse et al. | 72/150 |
| 4,709,574 A | | 12/1987 | Horn et al. | 72/356 |
| 4,732,025 A | | 3/1988 | Marlinga et al. | 72/150 |
| 4,959,984 A | | 10/1990 | Trudell et al. | 72/150 |
| 4,979,385 A | | 12/1990 | LaFrasse et al. | 72/149 |
| 5,197,320 A | * | 3/1993 | Saegusa | 72/307 |
| 5,305,223 A | | 4/1994 | Saegusa | 72/149 |
| 5,483,809 A | | 1/1996 | Nishiie et al. | 72/150 |
| 5,566,565 A | | 10/1996 | Saegusa | 72/306 |
| 5,797,289 A | | 8/1998 | Hoshino | 72/149 |
| 5,873,278 A | | 2/1999 | Saegusa | 72/149 |
| 6,295,857 B1 | * | 10/2001 | Rupoli | 72/307 |

FOREIGN PATENT DOCUMENTS

| | | | | |
|---|---|---|---|---|
| FR | 1227760 | * | 8/1960 | 72/149 |

* cited by examiner

*Primary Examiner*—Daniel C. Crane
(74) *Attorney, Agent, or Firm*—Anthony J. Casella; Gerald E. Hespos

(57) ABSTRACT

There is provided means for bending a small diameter metal pipe capable of accurately finishing all of bending operation by a single bender even when a linear length of a pipe distal end portion is short. A method of bending a small diameter metal pipe for chucking one end of the small diameter metal pipe to be worked, setting a working direction and carrying out bending operation from a front end side of other end to the one end, characterized in that bending operation of one step or several steps is carried out previously from a pipe distal end of the one end, a portion subjected to the bending operation is chucked and bending operation is successively carried out from the front end side of the other end toward the one end subjected to the bending operation under the state.

12 Claims, 4 Drawing Sheets

METHOD OF BENDING SMALL DIAMETER METAL PIPE AND ITS APPARATUS

BACKGROUND OF THE INVENTION

1. Field of the Invention

The present invention relates to a technology of bending a small diameter metal pipe.

2. Description of the Prior Arts

Conventionally, bending of a small diameter metal pipe is carried out mainly by manual working by using jigs operated manually. However, when bending of a small diameter metal pipe is carried out manually, sufficient working accuracy is not achieved and also working efficiency is poor. Meanwhile, there also are used a bending apparatus referred to as power bender which automatically carries out bending of a specific shape and a bending apparatus referred to as NC bender which automatically carries out various bending operations. Although the power bender is comparatively inexpensive in the installation cost and resolves problems in view of working accuracy and working efficiency, there are difficulties in which only bending of a specific shape can be carried out and a change in shape is difficult to deal with. Further, although the power bender can carry out complicated working to a small diameter metal pipe in a short period of time, its structure is complicated, the installation cost is problematic and also maintenance is complicated. Further, setting operation for changing working conditions is complicated and takes time.

In order to resolve the problems in the technology of bending a small diameter metal pipe as described above, there is known a technology of bending a small diameter metal pipe capable of carrying out simple and accurate bending operation to a small diameter metal pipe to be worked. The bending technology is a method of bending a small diameter metal pipe to be bent respectively set in respectively set working directions with respect to working positions at a plurality of portions of the small diameter metal pipe to be worked set in an axis center direction thereof and an apparatus thereof is constructed by a constitution having a pipe twist unit for chucking one end side of the small diameter metal pipe to be worked, setting a predetermined working direction by rotating the small diameter metal pipe to be worked centering on the axis center and moving the small diameter metal pipe to be worked in the axis center direction and setting the metal pipe at a predetermined working position and bending means for pivoting the small diameter metal pipe to be worked by a predetermined angle while pinching the metal pipe and bending the small diameter metal pipe to be worked and is generally referred to as CNC bender.

However, in the bending operation by the conventional CNC bender, when a length of a straight line at a distal end portion of the pipe is short, there is a case in which all of the bending operation cannot be carried out in the bender. In such a case, the pipe is removed from the bending apparatus while leaving the bending operation of the distal end portion of the pipe and bending is carried out by using an exclusive bending jig or the like.

FIG. 5 exemplifies a bending method in the case in which a length of a straight line at a distal end portion of a pipe is short in bending operation by the conventional CNC bender, the CNC bender 11 is provided with a pipe twist unit 11-1 having a chuck apparatus 11-2 for grasping one end side of a small diameter metal pipe P1 to be worked for setting a predetermined working direction by rotating the small diameter metal pipe P1 to be worked which is chucked by the chuck apparatus centering on the axis center and moving the small diameter metal pipe P1 to be worked in the axis center direction and setting the metal pipe at a predetermined working position and a bending apparatus 12 having a bending roller 12-1 and a clamp jig 12-2 pivoted by a predetermined angle on a peripheral face of the bending roller via the small diameter metal pipe to be worked while pressing the small diameter metal pipe P1 to be worked onto the peripheral face of the bending roller and successively bending the small diameter metal pipe to be worked from a front end side of other end thereof toward one end subjected to the bending operation, and a reaction force receive roller 12-3. Numeral 13 designates a separate bending jig.

That is, according to the conventional bending operation, one end side in a shape of a straight pipe of the small diameter metal pipe P1 to be worked is chucked by the chuck apparatus 11-2 of the pipe twist unit 11-1 of the CNC bender 11 and under the state, the bending operation is successively carried out from the front end side of the other end of the small diameter metal pipe P1 to be worked by the bending roller 12-1 and the clamp jig 12-2 for carrying out the bending operation by being pivoted by a predetermined angle on the peripheral face via the small diameter metal pipe to be worked while pressing the small diameter metal pipe P1 to the peripheral face of the bending roller and the reaction force receive roller 12-3, when the bending operation at the CNC bender 11 is finished, in the state of leaving bending operation of the distal end portion of the pipe on the side of the chuck apparatus 11-2, the small diameter metal pipe P1 to be worked is removed from the CNC bender 11 and transferred to a successive step and the distal end portion of the pipe is bent by the separate bending jig 13 to thereby finish the bending operation.

As described above, in the case of the bending operation in which the length of the distal end portion of the pipe in the bending operation by the CNC bender is short and all of the bending operation cannot be completed by the CNC bender, there poses a problem in which the bending operation needs to carry out by removing the small diameter metal pipe to be worked from the CNC bender and setting the material again to the separate working jig or the like, that is, two of the benders are needed and by using the separate working jig, not only the working accuracy is deteriorated by causing a shift in a length dimension, a shift in a twist direction or the like from a portion of the pipe which has already been bent but also time is taken in the bending operation by using the separate working jig or the like. Further, the separate bending working jig or the like used after the bending operation by the CNC bender frequently becomes exclusive depending on the shape of the bending operation and general use formation thereof is difficult.

SUMMARY OF THE INVENTION

The invention has been carried out in view of such a conventional actual situation for proposing a method of bending a small diameter metal pipe and its apparatus capable of finishing accurately all of bending operation in a CNC bender even when a linear length of a pipe distal end portion is short.

In order to resolve the above-described problem, according to a first embodiment of the invention, there is provided a method of bending a small diameter metal pipe, wherein in a method of bending a small diameter metal pipe for chucking one end of a small diameter metal pipe to be worked, carrying out a first bending operation at a first working position on a front end side of other end of the small diameter metal pipe to be worked, successively moving the small diameter metal pipe to be worked in an axis center direction thereof, carrying out a second bending operation similar to the above-described at a second working position from other end side of the small diameter metal pipe to be worked and successively carrying out the bending operations from the front end side of the other end toward the one end, before carrying out the first bending operation, a bending operation of one step or several steps is previously carried out from a pipe distal end of the one end, a portion of the small diameter metal pipe subjected to the bending operation is chucked, under the state, the bending operation is successively carried out from the front end side of the other end toward the one end subjected to the bending operation. Further, in a case in which there is a directionality in a direction of a part relative to a bending plane thereafter such as an eye joint or the like attached to a pipe end portion, after correctly producing the directionality of the part of the eye joint or the like beforehand, the one end of the small diameter metal pipe to be worked is chucked and the first bending operation is carried out at the first working position on the front end side of the other end of the small diameter metal pipe to be worked.

Further, according to a second embodiment of the invention, there is provided an apparatus of bending a small diameter metal pipe having a first bending apparatus for carrying out a bending operation to a pipe distal end of one end of a small diameter metal pipe to be worked and a second bending apparatus for chucking a portion of the small diameter metal pipe subjected to the bending operation by the first bending apparatus and carrying out successively a bending operation from a front end side of other end thereof toward the one end subjected to the bending operation under the state, wherein at least the second bending apparatus comprises a pipe twist unit movable in an axis center direction of the small diameter metal pipe to be worked, chucking the bent portion on the one end side of the small diameter metal pipe to be worked and capable of pivoting the small diameter metal pipe to be worked by a predetermined angle centering on an axis center thereof and bending means fixed to a predetermined position forward from the pipe twist unit in the axis center direction and having a bending roller and a clamp jig. for successively carrying out the bending operation from the front side of the other end of the small diameter metal pipe to be worked toward the one end subjected to the bending operation by being pivoted by a predetermined angle on a peripheral face of the bending roller via the small diameter metal pipe to be worked while pressing the small diameter metal pipe to be worked to the peripheral face of the bending roller and a reaction force receive piece.

Further, according to a third embodiment of the invention, there is provided an apparatus of bending a small diameter metal pipe having a first bending,apparatus for carrying out a bending operation to a pipe distal end of one end of a small diameter metal pipe to be worked and a second bending apparatus for chucking a portion of the small diameter metal pipe subjected to the bending operation by the first bending apparatus and successively carrying out a bending operation from a front end side of other end thereof toward the one end subjected to the bending operation under the state, wherein at least the second bending apparatus comprises a pipe twist unit movable in an axis center direction of the small diameter metal pipe to be worked, chucking the bent portion on the one end side of the small diameter metal pipe to be worked and capable of pivoting the small diameter metal pipe to be worked by a predetermined angle centering on an axis center thereof, and bending means fixed to a predetermined position forward from the pipe twist unit in the axis center direction and having a shape roll and a bending roll for successively carrying out the bending operation from the front end side of the other end of the small diameter metal pipe to be worked toward the one end subjected to the bending operation by being pivoted on a peripheral face of the shape roller by a predetermined angle while pressing the small diameter metal pipe to be worked to the peripheral face of the shape roll and a reaction receive piece.

Further, in the case of the small diameter metal pipe to be worked having a pipe end part of an eye joint or the like having a directionality relative to a bending plane thereafter at the pipe end portion, an apparatus of producing the directionality of the pipe end part of the small diameter metal pipe to be worked having the pipe end part is provided at a prestage of the first bending apparatus.

DETAILED DESCRIPTION OF PREFERRED EMBODIMENTS

According to the invention, numeral 1 designates a first bending apparatus (first bender), numeral 2 designates a second bending apparatus (second: bender), numeral 3 designates a pipe end part direction setting apparatus and notations P and Pi designate small diameter metal pipes to be worked.

Figure 1:
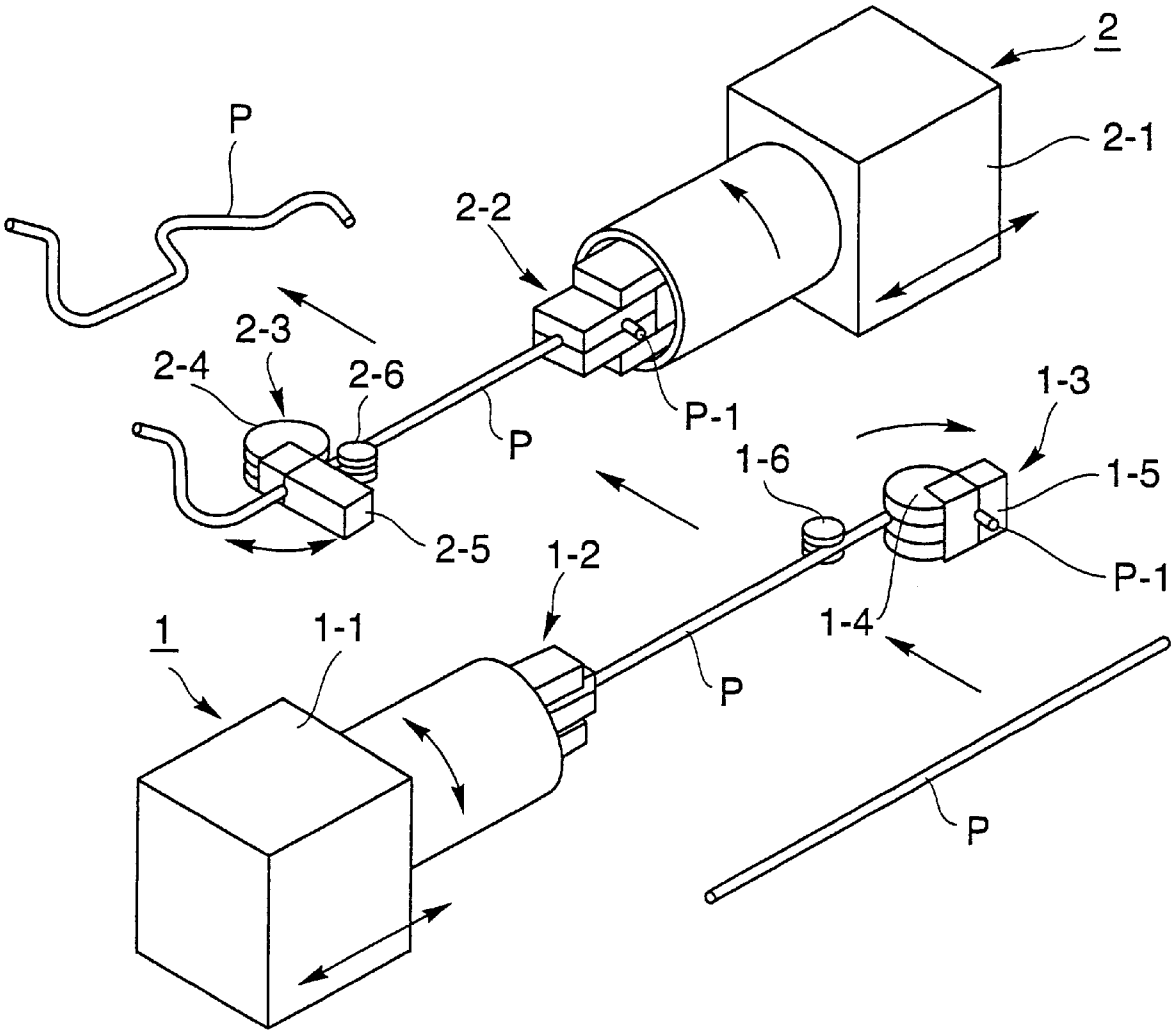
FIG. 1 is an outline perspective view showing an embodiment of an apparatus of bending a small diameter metal pipe according to the invention.

That is, as shown by FIG. 1, the first bending apparatus (first bender) 1 is an apparatus of bending a pipe distal end of one end of the small diameter metal pipe P to be worked and its constitution is provided with a pipe twist unit 1-1 having a chuck apparatus 1-2 for chucking other end side of the small diameter metal pipe P to be worked for setting a predetermined working direction by rotating the small diameter metal pipe P to be worked which is chucked by the chuck apparatus centering on the axis center and moving the small diameter metal pipe P to be worked in the axis center direction and setting one end side at a predetermined working position, and a bending apparatus 1-3 of a so-to-speak tension bending system having a bending roller 1-4 and a clamp jig 1-5 for carrying out bending operation by being pivoted by a predetermined angle on a peripheral face of the bending roller via the small diameter metal pipe P to be worked while pressing the small diameter metal pipe P to be worked to the peripheral face of the bending roller and a reaction force receive roller 1-6 as a reaction force receive piece.

Further, the chuck apparatus 1-2 of the pipe twist unit 1-1 is constructed by a structure of grasping a straight line portion of the other end side of the small diameter metal pipe P to be worked. Further, although twist of the pipe is needed when bending operation which is carried out at the one end of the small diameter metal pipe P to be worked is constituted by bending operation of several steps, twist of the pipe is not needed in the case of one step bending as illustrated. Therefore, the first bending apparatus (first bender) 1 is not limited to the illustrated constitution having the pipe twist unit 1-1 but a pertinent constitution may be selected and used in accordance with a number of steps of bending the one end side of the small diameter metal pipe P to be worked.

The second bending apparatus (second bender) 2 is installed contiguously to the first bending apparatus (first bender) 1 on a same base (illustration is omitted) by reversing the direction and its constitution per se is the same as that of the first bending apparatus except a chuck apparatus 2-2 of a pipe twist unit 2-1.

That is, the second bending apparatus (second bender) 2 is provided with the pipe twist unit 2-1 having the chuck apparatus 2-2 having a structure of chucking a bent portion of the one side pipe distal end portion of the small diameter metal pipe P to be worked in which the one side pipe distal end portion has previously been bent by the first bending apparatus 1 forgetting a predetermined working direction by rotating the small diameter metal pipe P to be worked which is chucked by the chuck apparatus 2-2 centering on the axis center and moving the small diameter metal pipe P to be worked in the axis center direction and setting the metal pipe at a predetermined working position, and a bending apparatus 2-3 of a so-to-speak tension bending system having a bending roller 2-4 and a clamp jig 2-5 for successively carrying out bending operation from a front end side of other end of the small diameter metal pipe P to be worked toward one end thereof subjected to the bending operation by being pivoted by a predetermined angle on a peripheral face of the bending roller via the small diameter metal pipe P to be worked while pressing the small diameter metal pipe P to be worked to the peripheral face of the bending roller and a reaction receive roller 2-6 as a reaction receive piece.

Figure 2:
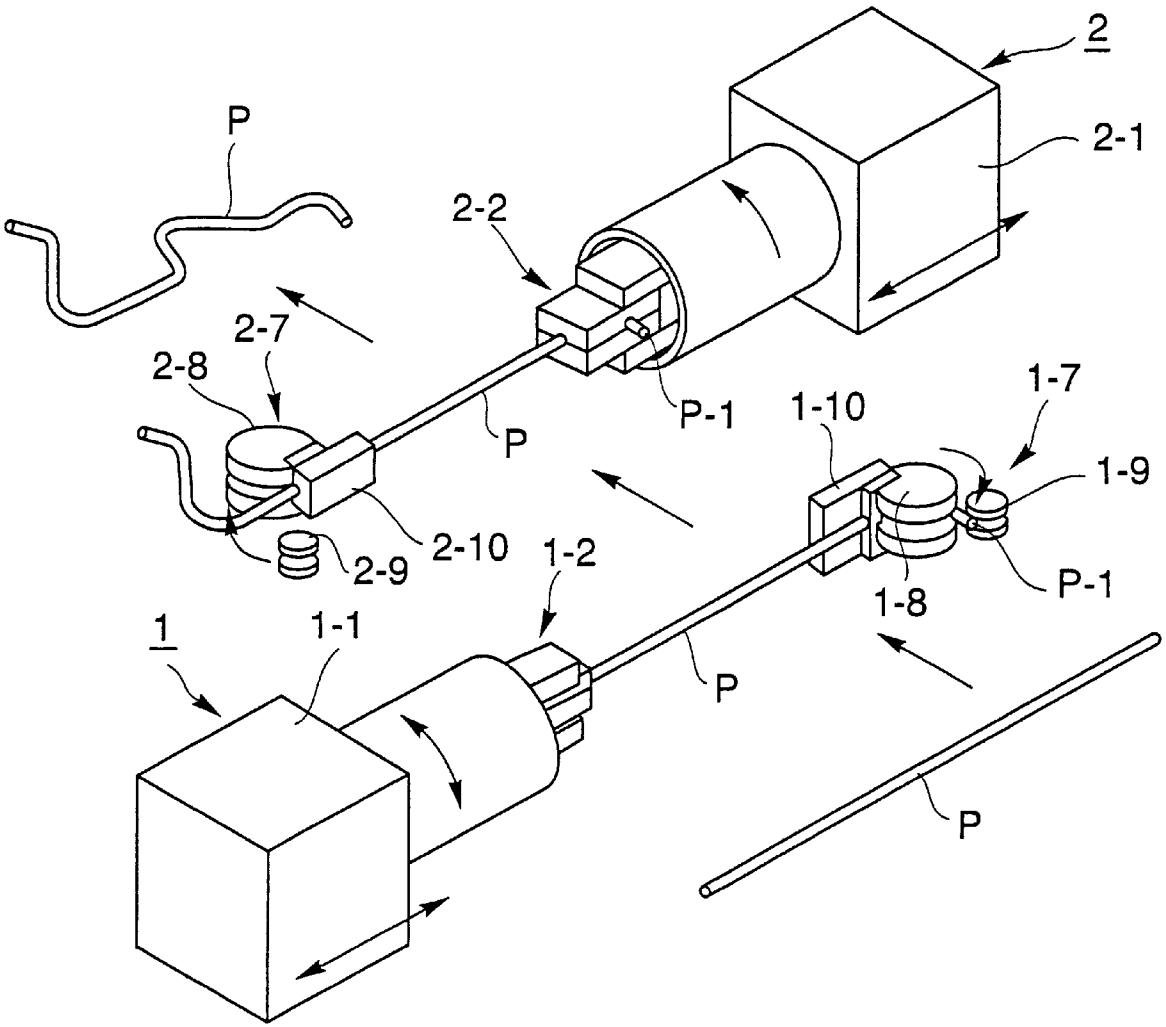
FIG. 2 is an outline perspective view showing other embodiment of an apparatus of bending a small diameter metal pipe according to the invention.

Next, according to other embodiment shown by FIG. 2, parts the same as those in the embodiment of FIG. 1 are attached with the same reference numerals and there is adopted a bending apparatus of a so-to-speak compression bending system as bending apparatus in the first bending apparatus (first bender) 1 and the second bending apparatus (second bender) 2.

That is, as shown in FIG. 2, there is provided an apparatus of bending a pipe distal end of one end of the small diameter metal pipe P to be worked and its, constitution is provided with the pipe twist unit 1-1 having the chuck apparatus 1-2 for chucking other end side of the small diameter metal pipe P to be worked for setting a predetermined working direction by rotating the small diameter metal pipe P to be worked which is chucked by the chuck apparatus centering on the axis center and moving the small diameter metal pipe P to be worked in the axis center direction and setting the one end side at a predetermined working position and a bending apparatus 1-7 of a so-to speak compression bending system having a bending roll 1-9 for carrying out bending operation by being pivoted by a predetermined angle on a peripheral face of a shape roll 1-8 while pressing the small diameter metal pipe P to be worked onto the peripheral face of the shape roll 1-8 and a reaction force receive metal piece 1-10 as a reaction force receive piece.

The second bending apparatus (second bender) 2 is installed contiguously to the first bending apparatus (first bender) 1 on the same base (illustration is omitted) by reversing the direction and the constitution per se is the same as that of the first bending apparatus except the chuck apparatus 2-2 of the pipe twist unit 2-1.

That is, the second bending apparatus (second bender) 2 is provided with the pipe twist unit 2-1 having the chuck apparatus 2-2 having the structure of chucking the bent portion of the one side pipe distal end portion of the small diameter metal pipe P to be worked in which the one side pipe distal end portion has previously been bent by the first bending apparatus 1 for setting a predetermined working direction by rotating the small diameter metal pipe P to be worked which is chucked by the chuck apparatus 2-2 centering on the axis center and moving the small diameter metal pipe P to be worked in the axis center direction and setting the metal pipe at a predetermined working position, and a bending apparatus 2-7 of a so-to-speak compression bending system having a bending roll 2-9 for successively carrying out bending operation from a front end side of other end of the small diameter metal pipe P to be worked toward one end thereof subjected to the bending operation by being pivoted by a predetermined angle on a peripheral face of a shape roll 2-8 while pressing the small diameter metal pipe P to be worked onto the peripheral face of the shape roll 2-8 and a reaction receive metal piece 2-10 as a reaction force metal piece.

Further, according to the invention, the chuck apparatus 2-2 of the second bending apparatus is constituted such that there is carried out grooving operation matching a contour of the bent portion bent by the first bending apparatus 1 and chucking is carried out by fitting the bent portion of the one side pipe distal end portion to the groove portion.

Further, although according to the embodiment of FIG. 1, as the bending apparatus, there are shown the bending apparatus 1-3 and 2-3 of the tension bending system and according to the embodiment of FIG. 2, as the bending: apparatus, there are shown the bending apparatus 1-7 and 2-7 of the compression bending system, the system of the bending apparatus according to the invention is not particularly limited but, for example, the bending apparatus of the tension bending system may be adopted to the first bending apparatus (first bender) 1 and the bending apparatus of the compression bending system may be adopted to the second bending apparatus (second bender) 2, or conversely, the bending apparatus of the compression bending system may be adopted to the first bending apparatus (first bender) 1 and the bending apparatus of the tension bending system may be adopted to the second bending apparatus (second bender) 2.

Further, naturally, the bending apparatus having the above-described constitution is attached with a pipe carry-in apparatus (illustration is omitted) for supplying the small diameter metal pipe P to be worked to the first bending apparatus (first bender) 1, a pipe deliver apparatus (illustration is omitted) for delivering the small diameter metal pipe P subjected to the bending operation at the first bending apparatus (first bender) 1 to the second bending apparatus (second bender) 2, a pipe carry-out apparatus (illustration is omitted) for carrying out the small diameter metal pipe P finished with the bending operation at the second bending apparatus (second bender) 2 to a product stock portion side and so on.

In carrying out bending operation to the small diameter metal pipe P to be worked by the bending apparatus having the above-described constitution, one piece of the small diameter metal pipe P to be worked is supplied from a pipe carry-in apparatus (illustration is omitted) to the first bending apparatus (first bender) 1. At this occasion, a straight pipe portion on other end side of the small diameter metal pipe P to be worked is chucked by the chuck apparatus 1-2 of the pipe twist unit 1-1, thereafter, the pipe twist unit 1-1 is moved in the pipe axis direction and one end side of-the small diameter metal pipe P to be worked is transferred to a working position of the bending apparatus 1-3 of the tension bending system or bending apparatus 1-7 of the compression bending system.

Successively, in the bending apparatus 1-3 of the tension bending system, when the small diameter metal pipe p to be worked is held between the bending roller 1-4 and the reaction force receive roller 1-6 and the small diameter metal pipe P is clamped by the clamp jig 1-5, first bending operation is carried out by pivoting the clamp jig 1-5 by a predetermined angle on the peripheral face of the bending roller 1-4 via the small diameter metal pipe P to be worked while pressing the small diameter metal pipe P to be worked onto the peripheral face of the bending roller 1-4. By the first bending operation, predetermined bending operation in correspondence with the pivoting angle of the bending roller 1-4 and the clamp jig 1-5 is carried out to one end side of the small diameter metal pipe P to be worked.

Further, in the bending apparatus 1-7 of the compression bending system, the small diameter metal pipe P to be worked is held between the shape roll 2-8 and the bending roll 1-9 and the first bending operation is carried out by pivoting the bending roll 1-9 by a predetermined angle centering on the shape roll 1-8 while pressing the small diameter metal pipe P to be worked onto the peripheral face of the shape roll 1-8 in a state in which the reaction receive metal piece 1-10 is brought into contact with the outer peripheral face of the small diameter metal pipe P to be worked. By the first bending operation, predetermined bending operation in correspondence with a pivoting angle of the bending roll 1-9 is carried out at one end side of the small diameter metal pipe P to be worked.

When the bending operation on the one end side of the small diameter metal pipe P to be worked is finished by the first bending apparatus (first bender) 1 in this way, the small diameter metal pipe P to be worked is delivered to the second bending apparatus (second bender) 2 by a pipe deliver apparatus (illustration is omitted). At the second bending apparatus (second bender) 2, one end side bending portion P-1 of the small diameter metal pipe P to be worked is chucked by the chuck apparatus 1-2 of the pipe twist unit 2-1 and the pipe twist unit 2-1 is moved in the axis center direction.

Further, in the case of the bending apparatus 2-3 of the tension bending system, when the small diameter metal pipe P to be worked is held between the bending roller 2-4 and the reaction force receive roller 2-6 and the small diameter metal pipe P to be worked is clamped by the clamp jig 2-5, the clamp jig 2-5 is pivoted by a predetermined angle on the peripheral face of the bending roller 2-4 via the small diameter metal pipe P to be worked while pressing the small diameter metal pipe P to be worked onto the peripheral face of the bending roller 2-4 and the bending operation is successively carried out from a front end side of other end of the small diameter metal pipe P to be worked toward the one end side worked portion P-1 subjected to the bending operation.

Meanwhile, in the case of the bending apparatus 2-7 of the compression bending system, when the small diameter metal pipe P is held between the shape roll 2-8 and the bending roll 2-9 and the reaction receive metal piece 2-10 is brought into contact with the small diameter metal pipe P to be worked, the bending roll 2-9 is pivoted by a predetermined angle on the peripheral face of the shape roll 2-8 centering on the shape roll 2-8 while pressing the small diameter metal pipe P to be worked onto the peripheral face of the shape roll 2-8 and the bending operation is successively carried out from the front end side of the other end of the small diameter metal pipe P to be worked toward the one end side worked portion P-1 subjected to the bending operation.

When the bending operation from the other end side of the small diameter metal pipe P to be worked has been finished by the second bending apparatus (second bender) 2 in this way, that is, when bending of one piece of the small diameter metal pipe P to be worked has been finished, the small diameter metal pipe P to be worked which is finished with the bending operation is taken out by a pipe carry-out apparatus (illustration is omitted) and is carried out to a product stock side. Thereafter, operation similar to the above-described is repeated for each piece of the small diameter metal pipe to be worked and predetermined bending operation is carried out to the small diameter metal pipe P to be worked.

Figure 3:
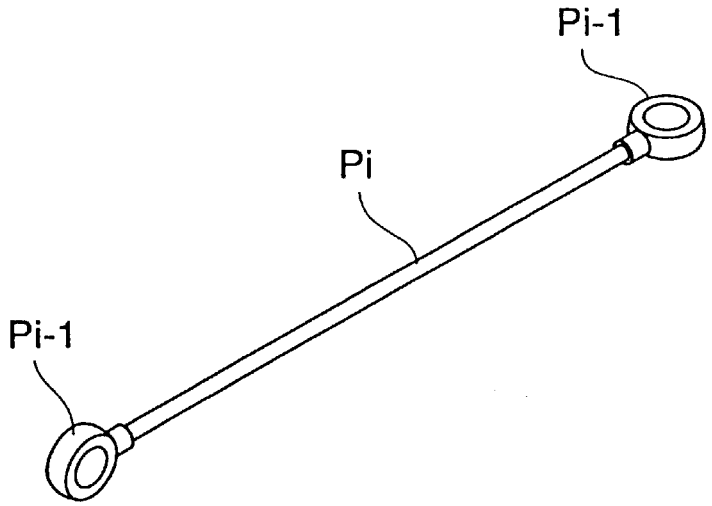
FIG. 3 is a perspective view showing an example of a small diameter metal pipe to be worked which is attached with parts having directionalities at pipe end portions thereof.
Figure 4:
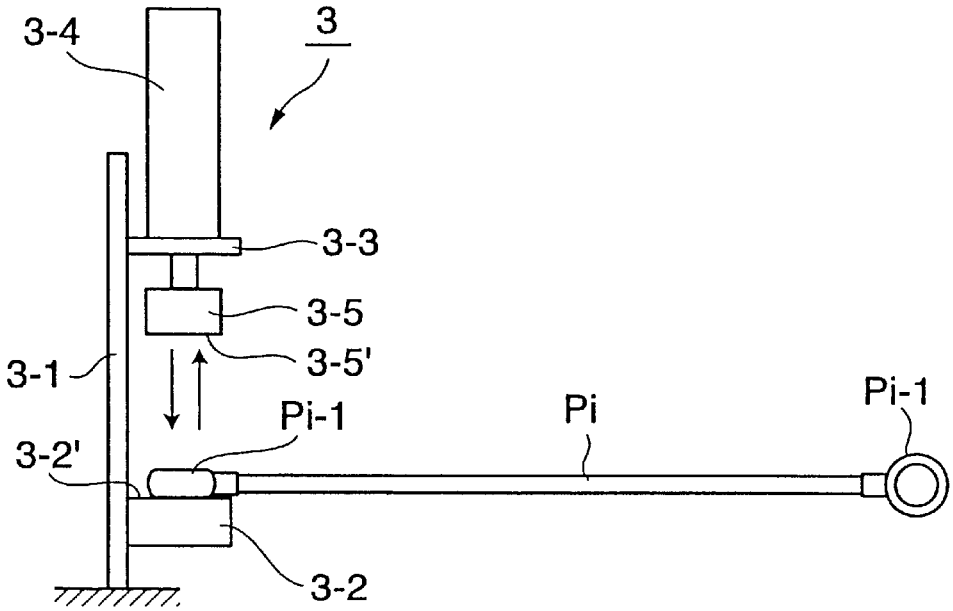
FIG. 4 is an outline view showing an example of an apparatus for producing the directionalities of the pipe end parts of the diameter metal pipe to be worked having the p end parts shown in FIG. 3.
Figure 5:
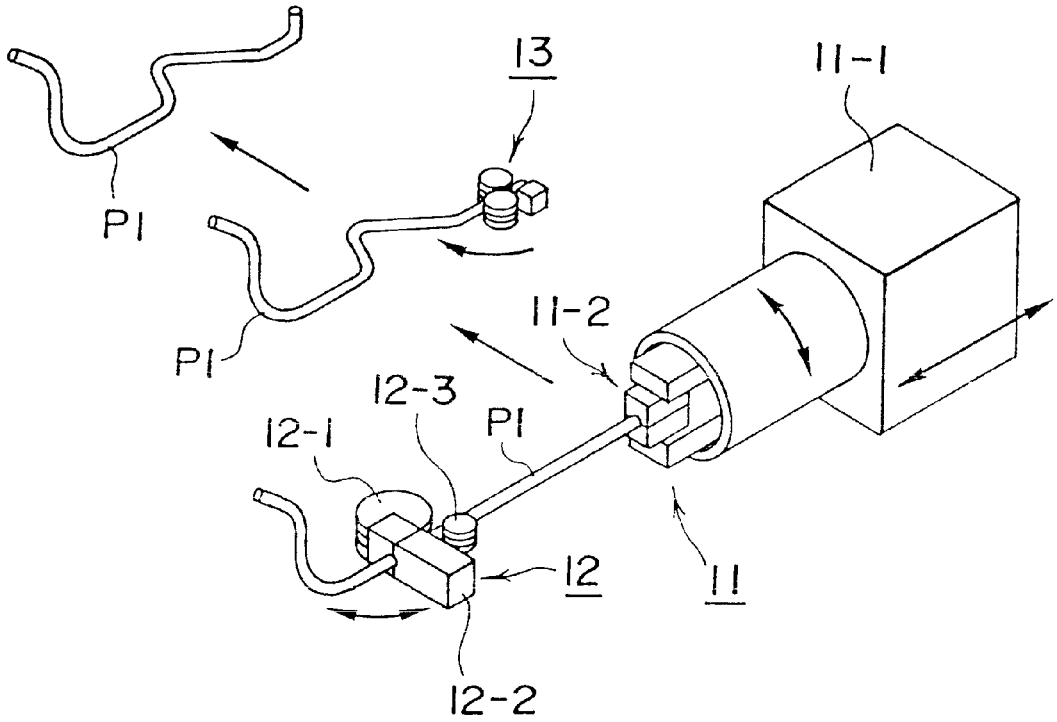
Fig. 5 PRIOR ART
FIG. 5 is an outline perspective view showing an example of a conventional apparatus of bending a small diameter metal pipe constituting an object of the invention.

Although in FIG. 1 and FIG. 2, an explanation has been given of an example of bending the small diameter metal pipe P to be worked which is not provided with a part at the pipe end portion, as shown by FIG. 3, in the case of the small diameter metal pipe Pi to be worked having directionalities at, for example, pipe end portions there is used the pipe end part direction setting apparatus 3 showing an example thereof in FIG. 4 and the small diameter metal pipe Pi to be worked is supplied to the first bending apparatus (first bender) 1 after producing correctly the directionalities of eye joints of Pi-1 of the small diameter metal pipe Pi to be worked beforehand by the apparatus.

The pipe end part direction setting apparatus 3 used as means for producing the directionalities of the eye joints Pi-1 of the small diameter metal pipe Pi to be worked, is constituted by a support plate 3-1 installed vertically, a part receive 3-2 projected horizontally at a lower portion of the support plate 3-1 and having a guide plane 3-2' for horizontally mounting the eye joint Pi-1 of the small diameter metal pipe Pi to be worked and a vertical cylinder (hydraulic cylinder) 3-4 attached with a part hold member 3-5 having a press plane 3-5' in parallel with the guide plane. 3-2' at a front end of a rod on a base plate 3-3 projected horizontally from the support plate 3-1 at an upper position thereof opposed to the part receive 3-2 and is installed at a prestage of the first bending apparatus (first bender) 1.

That is, in carrying out bending operation to the small diameter metal pipe Pi to be worked having the eye joints Pi-1 having directionalities relative to a bending plane at pipe end portions thereof, before supplying the metal pipe Pi from a pipe carry-in apparatus (illustration is omitted) to the first bending apparatus (first bender) 1, firstly, by the pipe end part direction setting apparatus 3, the directionalities of the eye joints Pi-1 relative to the bending plane by the first bender are correctly produced. According to the operation, in a state in which the eye joint Pi-1 of one piece of the small diameter metal pipe Pi to be worked having the eye joint Pi-1 carried from a pipe carry-in apparatus (illustration is omitted), is mounted on the guide plane 3-2' of the part receive 3-2, the vertical cylinder 3-4 is operated in the downward direction and the eye. joint Pi-1 is pressed by the press plane 3-5' of the part hold member 3-5 at the front end of the rod to thereby correctly produce the directionality.

Thereafter, the small diameter metal pipe Pi to be worked is supplied to the first bending apparatus (first bender). 1 such that the metal pipe is not twisted, the metal pipe. is chucked by the chuck apparatus 1-2 of the pipe twist unit 1-1 while maintaining correct directionalities of the eye joints Pi-1 and is subjected to the bending operation similar to the above-described.

Further, although according to the embodiment, an explanation has been given of the case in which the distal end of one end of the small diameter metal pipe P or Pi is previously subjected to the bending operation in one step by the first bending apparatus 1, naturally, the bending operation which is carried out to the pipe distal end of one end of the small diameter metal pipe P or Pi to be worked is not limited to one step but several steps of bending operation may be carried out to the metal pipe and thereafter, the metal pipe may be carried and supplied to the second bending apparatus (second bender) 2.

Further, there is constructed a constitution in which a working position of the small diameter metal pipe P or Pi to be worked, a twist angle at the working position, an amount of moving the twist unit and so on in the bending apparatus of the invention, are previously inputted to an automatic control apparatus (illustration is omitted) and the bending operation is carried out to the small diameter metal pipe P or Pi to be worked fully automatically.

As has been explained, according to the invention, bending operation at the pipe distal end portion of the one end side is carried out by the first bending apparatus, the bending operation can successively be carried out from the pipe distal end portion on the other end side toward the one end side by the second bending apparatus installed on the base the same as that of the first bending apparatus contiguously thereto and therefore, there is achieved an enormous effect in bending a small diameter metal pipe such that even with a shape of a pipe having: two short pipe ends which has not been able to work by a single bending apparatus (CNC bender) and even with a pipe member attached with pipe end parts having directionalities such as eye joints or the like at two pipe end portions, bending operation can be carried out accurately, exclusive jigs or the like are dispensed with and working time period can be shortened.

What is claimed is:

1. An apparatus for bending an initially straight metal pipe, said pipe having opposite first and second ends, said apparatus comprising:

a first chuck configured for releasably gripping the first end of the pipe;

a first pipe bending means spaced from said first chuck for placing at least a first bend in proximity to said second end of said pipe;

a second chuck configured for releasably gripping the pipe at the first bend therein; and a second pipe bending means spaced from said second chuck for placing at least a second bend in said pipe in at least one location spaced from said first bend therein.

2. The apparatus of claim 1, further comprising a first moving means for rotating said first chuck about a first axis and for moving said first chuck along the first axis.

3. The apparatus of claim 2, further comprising a second moving means for rotating said second chuck about a second axis and for moving said second chuck along the second axis.

4. The apparatus of claim 3, wherein the first and second axes are substantially parallel.

5. The apparatus of claim 4, wherein the first and second chucks face in opposite directions.

6. The apparatus of claim 1, further comprising moving means for rotating the second chuck about an axis and for moving the second chuck along the axis.

7. The apparatus of claim 1, further including a means for affixing first and second pipe end pieces on said first and second ends of said pipe before placing said bends in said pipe.

8. The apparatus of claim 1, wherein the first pipe bending means is operative to form the first bend with a selected contour, the second chuck includes opposed grooves substantially matching the selected contour of the first bend.

9. A method for bending an initially straight metal pipe, said pipe having opposite first and second ends, said method comprising:

gripping said first end of said pipe in a first chuck;

placing a first bend in said pipe substantially adjacent said second end;

releasing said first end of said pipe from said first chuck;

gripping said first bend of said pipe in a second chuck; and placing at least a second bend in said pipe in at least one location spaced from said first bend.

10. The method of claim 9, further including the steps of:

moving said first chuck to position said second end of said pipe in proximity to a first bender for placing said first bend in said pipe; and moving said second chuck to position portions of said pipe spaced from said second end in proximity to a second bender for placing the second bend in the pipe.

11. The method of claim 9, wherein prior to gripping the first end of the pipe in the first chuck, the method further includes the steps of:

attaching a first pipe end piece to the first end of said pipe; and attaching a second pipe end piece to the second end of said pipe at a selected rotational orientation relative to the first pipe end piece.

12. The method of claim 11, wherein the gripping steps comprise gripping the respective pipe end pieces.

* * * * *